US006749127B2

(12) United States Patent
Lorraine et al.

(10) Patent No.: US 6,749,127 B2
(45) Date of Patent: Jun. 15, 2004

(54) METHOD OF FILLING FLUID IN A THERMAL COMPENSATOR

(75) Inventors: Jack Lorraine, Harrisburg, PA (US); Bogdan Gromek, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 164 days.

(21) Appl. No.: 10/071,205

(22) Filed: Feb. 11, 2002

(65) Prior Publication Data

US 2003/0150939 A1 Aug. 14, 2003

(51) Int. Cl.[7] ..... F02D 1/06; F02D 7/00; F02M 47/02; F02M 59/00; F02M 61/00

(52) U.S. Cl. ..... 239/5; 239/89; 239/533.2; 239/585.1

(58) Field of Search ..... 239/5, 89, 533.2, 239/585.1, 533.3, 533.9, 585.3, 585.4, 585.5; 123/516

(56) References Cited

U.S. PATENT DOCUMENTS

| | | | | |
|---|---|---|---|---|
| 3,753,426 | A | 8/1973 | Lilley | 123/139 E |
| 4,499,878 | A | 2/1985 | Igashira et al. | 123/478 |
| 4,529,164 | A | 7/1985 | Igashira et al. | 251/129 |
| 4,550,744 | A | 11/1985 | Igashira et al. | 137/80 |
| 4,553,059 | A | 11/1985 | Abe et al. | 310/328 |
| 4,584,980 | A | 4/1986 | Weiger et al. | |
| 4,608,958 | A | 9/1986 | Sakakibara et al. | 123/605 |
| 4,610,426 | A | 9/1986 | Bradner | |
| 4,649,886 | A | 3/1987 | Igashira et al. | 123/498 |
| 4,725,002 | A | 2/1988 | Trachte | 239/102.2 |
| 4,735,185 | A | 4/1988 | Imoto et al. | 123/498 |
| 4,803,393 | A | 2/1989 | Takahashi | |
| 5,036,821 | A | 8/1991 | Horiuchi et al. | 123/506 |
| 5,080,079 | A | 1/1992 | Yoshida et al. | 123/531 |
| 5,176,122 | A | 1/1993 | Ito | 123/478 |
| 5,605,134 | A | 2/1997 | Martin | 123/467 |
| 5,779,149 | A | 7/1998 | Hayes, Jr. | 239/124 |
| 5,810,255 | A | 9/1998 | Itoh et al. | 239/102.2 |
| 6,006,720 | A | 12/1999 | Yanagihara et al. | 123/305 |
| 6,062,533 | A | 5/2000 | Kappel et al. | 251/57 |
| 6,142,443 | A | 11/2000 | Potschin et al. | 251/57 |
| 6,148,842 | A | 11/2000 | Kappel et al. | 137/79 |
| 6,168,133 | B1 | 1/2001 | Heinz et al. | 251/57 |
| 6,213,414 | B1 | 4/2001 | Stier et al. | 239/584 |
| 6,260,541 | B1 | 7/2001 | Ricci-Ottati et al. | 123/498 |
| 6,499,471 | B2 * | 12/2002 | Shen et al. | 123/498 |

FOREIGN PATENT DOCUMENTS

| | | |
|---|---|---|
| DE | 197 08 304 | 9/1998 |
| DE | 197 27 992 | 1/1999 |
| DE | 198 26 339 | 12/1999 |
| DE | 198 38 862 | 3/2000 |
| DE | 198 54 506 | 4/2000 |
| DE | 198 56 617 | 6/2000 |
| DE | 198 58 476 | 6/2000 |
| DE | 199 02 260 | 9/2000 |
| DE | 199 11 048 | 9/2000 |
| EP | 0 869 278 | 10/1998 |
| JP | 63-158301 | 7/1998 |
| WO | WO 94/18449 | 8/1994 |

* cited by examiner

*Primary Examiner*—Gene Mancene
*Assistant Examiner*—Darren Gorman

(57) ABSTRACT

At least one method of degasifying, filling fluid and assembling a hydraulic compensator for a solid state actuated fuel injector is disclosed. The method involves partially assembling a compensator assembly and immersing the partial assembly in a hydraulic fluid and under a vacuum for a first predetermined time period. The partially assembled compensator is then assembled while immersed in the fluid and under a vacuum for a second time period.

15 Claims, 3 Drawing Sheets

METHOD OF FILLING FLUID IN A THERMAL COMPENSATOR

FIELD OF THE INVENTION

The invention generally relates to length-changing electromechanical solid state actuators such as an electrostrictive, magnetostrictive or solid-state actuator. In particular, the present invention relates to a compensator assembly for a length-changing actuator, and more particularly to an apparatus and method for degasifying or fluid filling a solid state actuated high-pressure fuel injector for internal combustion engines.

BACKGROUND OF THE INVENTION

A known solid-state actuator includes a ceramic structure whose axial length can change through the application of an operating voltage or magnetic field. It is believed that in typical applications, the axial length can change by, for example, approximately 0.12%. In a stacked configuration of piezoelectric elements of a solid-state actuator, the change in the axial length is magnified as a function of the number of elements in the actuator. Because of the nature of the solid-state actuator, it is believed that a voltage application results in an instantaneous expansion of the actuator and an instantaneous movement of any structure connected to the actuator. In the field of automotive technology, especially, in internal combustion engines, there is a need for the precise opening and closing of an injector valve element for optimizing the spray and combustion of fuel. Therefore, in internal combustion engines, solid-state actuators are now employed for the precise opening and closing of the injector valve element.

During operation, components of an internal combustion engine experience significant thermal fluctuations that result in the thermal expansion or contraction of the engine components. For example, a fuel injector assembly includes a valve body that may expand during operation due to the heat generated by the engine. Moreover, a valve element operating within the valve body may contract due to contact with relatively cold fuel. If a solid state actuator is used for the opening and closing of an injector valve element, it is believed that the thermal fluctuations can result in valve element movements that can be characterized as an insufficient opening stroke, or an insufficient sealing stroke. It is believed that this is because of the low thermal expansion characteristics of the solid-state actuator as compared to the thermal expansion characteristics of other fuel injector or engine components. For example, it is believed that a difference in thermal expansion of the housing and actuator stack can be more than the stroke of the actuator stack. Therefore, it is believed that any contractions or expansions of a valve element can have a significant effect on fuel injector operation.

It is believed that conventional methods and apparatuses that compensate for thermal changes affecting solid state actuator operation have drawbacks in that they either only approximate the change in length, they only provide one length change compensation for the solid state actuator, or that they only accurately approximate the change in length of the solid state actuator for a narrow range of temperature changes.

It is believed that there is a need to provide thermal compensation that overcomes the drawbacks of conventional methods.

SUMMARY OF THE INVENTION

The present invention provides a method of degasifying a fluid of a compensator that compensates for distortion of a fuel injector due to thermal distortion, brinelling, wear and mounting distortion. In particular, the compensator includes a body including a first body end and a second body end extending along a longitudinal axis. The body has a body inner surface facing the longitudinal axis and a fitting, a first piston having a first working surface and a second working surface distal to the first working surface. The first piston includes an extension portion coupled to the first piston. A second piston disposed proximate the extension portion of the first piston and having a spring disposed therebetween. The second piston has a surface that confronts the second working surface, a first sealing member coupled to the second piston, and a flexible fluid barrier coupled to the first piston and the second piston. In a preferred embodiment, the method is achieved by immersing the piston assembly in a container of fluid; and establishing a pressure on the medium acting on the fluid that is lower than ambient air pressure so that a gaseous medium trapped in at least one of the fluid and the piston assembly is generally removed therefrom.

The present invention further provides for a method of filling a compensator that compensates for distortion of a fuel injector due to thermal distortion, brinelling, wear and mounting distortion. The compensator includes a body having a first body end and a second body end extending along a longitudinal axis. The body has a body inner surface facing the longitudinal axis and a fitting, a first piston having a first working surface and a second working surface distal to the first working surface. The first piston includes an extension portion coupled to the first piston. A second piston disposed proximate the first piston. The second piston has a surface that confronts the second working surface, a first sealing member coupled to the second piston, and a flexible fluid barrier. In a preferred embodiment, the method is achieved by providing a gap between the first piston and the second piston by coupling the first piston and second piston to form a piston assembly; immersing the piston assembly in a container containing fluid; and establishing a pressure on the fluid in the container to a predetermined pressure for at least one predetermined time period.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
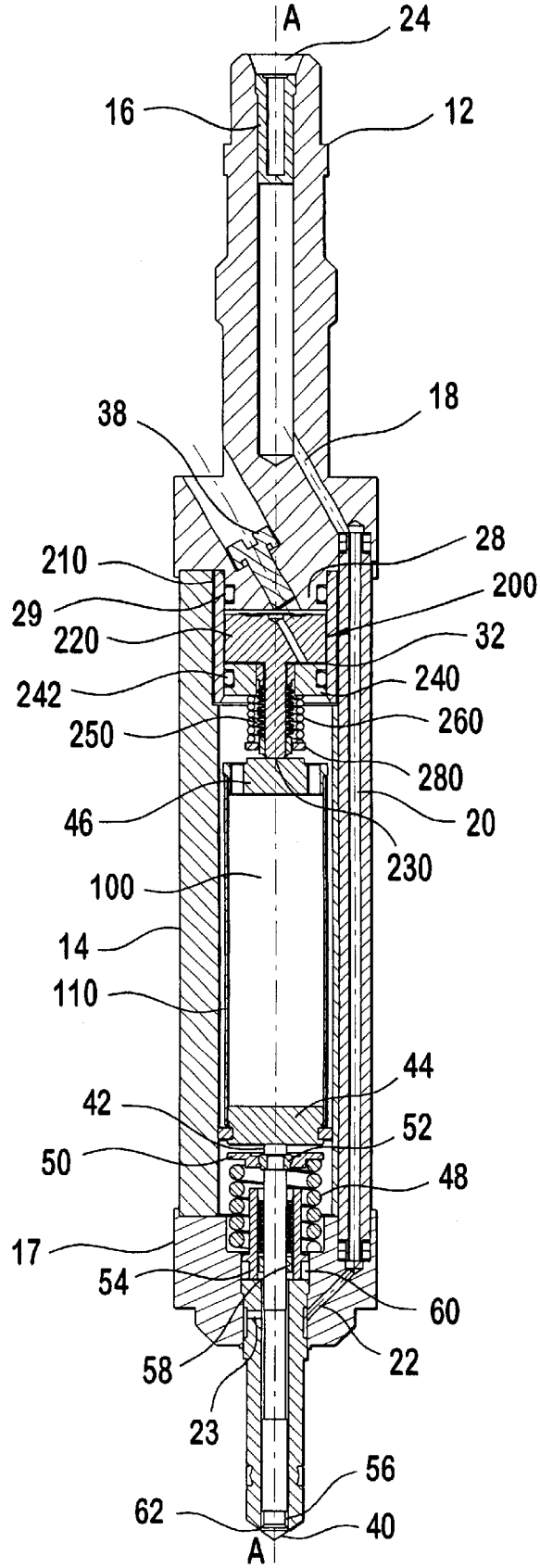
FIG. 1 is a cross-sectional view of a fuel injector assembly having a solid-state actuator stack and a compensator unit of a preferred embodiment.

Referring to FIGS. 1–4, a preferred embodiment is shown. FIG. 1 illustrates a preferred embodiment of a fuel injector assembly 10 that has a solid-state actuator stack 100 and a compensator assembly 200. The fuel injector assembly 10 includes inlet fitting 12, injector housing 14, and valve body 17. The inlet fitting 12 includes a fuel filter 16, fuel passageways 18, 20 and 22, and a fuel inlet 24 connected to a fuel source (not shown). The inlet fitting 12 also includes an inlet end member 28 (FIG. 2) with an O-ring 29. The inlet end member has a port 30 that can be used to fill a reservoir 32 with fluid 36 after a filler plug 38 is removed. The filler plug can be coupled to the injector housing by a suitable technique such as threading, sealing or permanently bonding the filler plug 38 to the housing. The fluid 36 can be a substantially incompressible fluid that is responsive to temperature change by changing its volume. Preferably, the fluid 36 is either silicon or other type of hydraulic type fluid that has a higher coefficient of thermal expansion than that of the injector inlet 12, the housing 14 or other components of the fuel injector. Also preferably, the filler plug 38 is connected to the housing by a threaded connection.

In the preferred embodiment, injector housing 14 encloses the solid-state actuator stack 100 and the compensator assembly 200. Valve body 17 is fixedly connected to injector housing 14 and encloses a valve closure member 40. The solid-state actuator stack 100 includes a plurality of solid-state actuators that can be operated through contact pins (not shown) that are electrically connected to a voltage source. When a voltage is applied between the contact pins (not shown), the solid-state actuator stack 100 expands in a lengthwise direction. A typical expansion of the solid-state actuator stack 100 may be on the order of approximately 30–50 microns, for example. The lengthwise expansion can be utilized for operating the injection valve closure member 40 for the fuel injector assembly 10.

Solid-state actuator stack 100 is guided along housing 14 by means of tubular extension spring 110, which holds the stack 100 under compression. The solid-state actuator stack 100 has a first end in operative contact with a closure end 42 of the valve closure member 40 by means of bottom 44, and a second end of the stack 100 that is operatively connected to compensator assembly 200 by means of a top 46.

Fuel injector assembly 10 further includes a spring 48, a spring washer 50, a keeper 52, a connection tube 54 (that joins the bellows 58 to the valve body 17 by a hermetic connection), a valve closure member seat 56, a bellows 58, and an O-ring 60. 0-ring 60 is preferably a fuel compatible O-ring that remains operational at low ambient temperatures (–40 C.° or less) and at operating temperatures (140 C.° or more).

Figure 2:
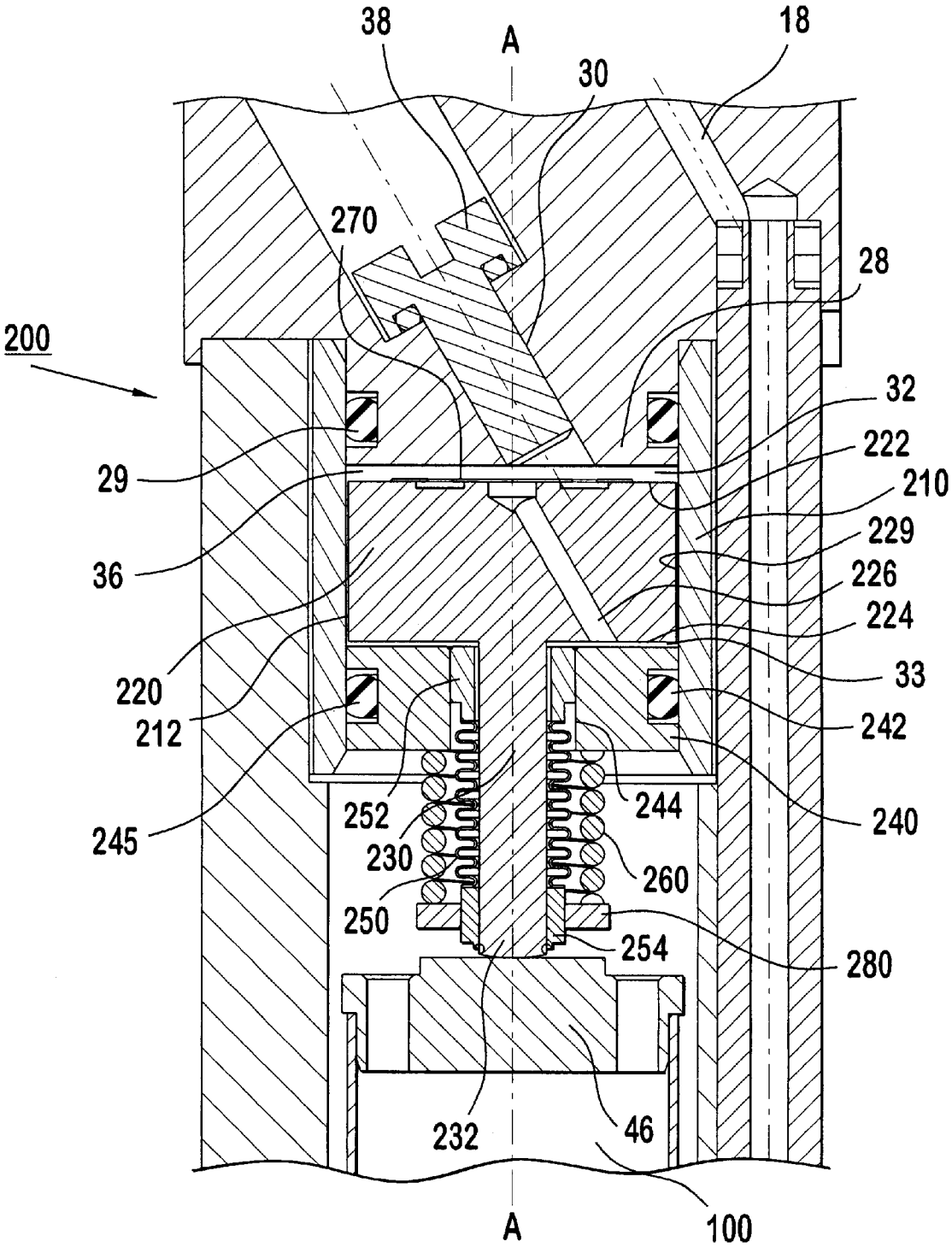
FIG. 2 is an enlarged view of the compensator assembly in FIG. 1.

Referring to FIG. 2, compensator assembly 200 includes a body 210 encasing a first piston 220, a piston stem or an extension portion 230, a second piston 240, bellows 250 and elastic member or spring 260. The body 210 can be of any suitable cross-sectional shape that provides a mating fit with the first and second pistons, such as, for example, oval, square, rectangular or any suitable polygons. Preferably, the cross section of the body is circular, thereby forming a cylindrical body.

The extension portion 230 extends from the first piston 220 so as to be linked by an extension end 232 to the top 46 of the piezoelectric stack 100. Preferably, the extension portion 230 is integrally formed as part of the first piston 220. Alternatively, the extension portion can be formed separate from the first piston 220 and coupled to the first piston 220 by, for example, a spline coupling, ball joint or other suitable couplings.

First piston 220 is disposed in a confronting arrangement with the inlet end member 28. An outer peripheral surface 229 of the first piston 220 is dimensioned so as to form a close tolerance fit with a body inner surface 212, i.e. a controlled clearance that allows lubrication of the piston and the body while also forming a hydraulic seal that controls the amount of fluid leakage through the clearance. The clearance between the first piston 220 and body 210 provides a leakage flow path from the first fluid reservoir 32 to the second fluid reservoir 33, and reduces friction between the first piston 220 and the body 210, thereby minimizing hysteresis in the motion of the first piston 220. It is believed that side loads introduced by the stack 100 would increase the friction and hysteresis. As such, the first piston 220 is coupled to the stack 100, preferably only in the direction along the longitudinal axis A—A so as to reduce or even eliminate any side loads. The body 210 is free floating relative to the injector housing, thus preventing distortion. Furthermore, by having a spring contained within the piston subassembly, little or no external side forces or moments are introduced in the compensator assembly 200.

To permit fluid 36 to selectively circulate between a first face 222 of the first piston 220 and a second face 224 of the first piston, a passage 226 extends between the first and second faces. A pressure sensitive valve is disposed in the first fluid reservoir 32 that allows fluid flow in one direction, depending on the pressure drop across the pressure sensitive valve. The pressure sensitive valve can be, for example, a check valve or a one-way valve. Preferably, the pressure sensitive valve is a flexible thin-disc plate 270 having a smooth surface disposed atop the first face 222, shown here in FIG. 4.

Specifically, by having a smooth surface on the side contiguous to the first piston 220 that forms a sealing surface with the first face 222, the plate 270 functions as a pressure sensitive valve that allows fluid to flow between a first fluid reservoir 32 and a second fluid reservoir 33 whenever pressure in the first fluid reservoir 32 is less than pressure in the second reservoir 33. That is, whenever there is a pressure differential between the reservoirs, the smooth surface of the plate 270 is lifted up to allow fluid to flow to the channels or pockets 228*a*, 228*b*. It should be noted here that the plate forms a seal to prevent flow as a function of the pressure differential instead of a combination of fluid pressure and spring force as in a ball type check valve. The pressure sensitive valve or plate 270 includes orifices 272*a* and 272*b* formed through its surface. The orifice can be, for example, square, circular or any suitable through orifice. Preferably, there are twelve orifices formed through the plate with each orifice having a diameter of approximately 1.0 millimeter. Also preferably, each of the channels or pockets 228*a*, 228*b* has an opening that is approximately the same shape and cross-section as each of the orifices 272*a* and 272*b*. The plate 270 is preferably welded to the first face 222 at approximately four or more different locations 276 around the perimeter of the plate 270.

Because the plate 270 has very low mass and is flexible, it responds very quickly with the incoming fluid by lifting up towards the end member 28 so that fluid that has not passed through the plate adds to the volume of the hydraulic shim. The plate 270 approximates a portion of a spherical shape as it pulls in a volume of fluid that is still under the plate 270 and in the passage 226. This additional volume is then added to the shim volume but whose additional volume is still on the first reservoir side of the sealing surface. One of the many benefits of the plate 270 is that pressure pulsations are quickly damped by the additional volume of hydraulic fluid that is added to the hydraulic shim in the first reservoir. This is because activation of the injector is a very dynamic event and the transition between inactive, active and inactive creates inertia forces that produce pressure fluctuations in the hydraulic shim. The hydraulic shim, because it has free flow in and restricted flow of the hydraulic fluid out of the first fluid reservoir 32, quickly dampens the oscillations.

The through hole or orifice diameter of the orifice of the passage 226 can be thought of as the effective orifice diameter of the plate instead of the lift height of the plate 270 because the plate 270 approximates a portion of a spherical shape as it lifts away from the first face 222. Moreover, the number of orifices and the diameter of each orifice determine the stiffness of the plate 270, which is critical to a determination of the pressure drop across the plate 270. Preferably, the pressure drop should be small as compared to the pressure pulsations in the first reservoir 32 of the compensator. When the plate 270 has lifted approximately 0.1 mm, the plate 270 can be assumed to be wide open, thereby giving unrestricted flow into the first reservoir 32. The ability to allow unrestricted flow into the hydraulic shim prevents a significant pressure drop in the fluid. This is believed to be important because when there is a significant pressure drop, the residual gas dissolved in the fluid (that was not evacuated in the filling process) comes out, forming bubbles. This is due to the vapor pressure of the gas exceeding the reduced fluid pressure (i.e. certain types of fluid take on air like a sponge takes on water, thus, making the fluid behaves like a compressible fluid.). The bubbles formed act like little springs making the compensator "soft" or "spongy". Once formed, it is difficult for these bubbles to re-dissolve into the fluid. The compensator, preferably by design, operates between approximately 2 and 7 bars of pressure and it is believed that the hydraulic shim pressure does not drop significantly below atmospheric pressure. Thus, degassing of the fluid and compensator passages is not as critical as it would be without the plate 270. Preferably, the thickness of the plate 270 is approximately 0.1 millimeter and its surface area is approximately 110 millimeter squared ($mm^2$). Furthermore, to maintain a desired flexibility of the plate 270, it is preferable to have an array of approximately twelve orifices, each orifice having an opening of approximately 0.8 millimeter squared ($mm^2$), and the thickness of the plate is preferably the result of the square root of the surface area divided by approximately 94.

Pockets or channels 228*a* and 228*b* can be formed on the first face 222. The pockets 228*a* and 228*b* ensure that some fluid 36 can remain on the first face 222 to act as a hydraulic "shim" even when there is little or no fluid between the first face 222 and the end member 28. In a preferred embodiment, the first reservoir always has at least some fluid disposed therein. The first face 222 and the second face 224 can be of any suitable shapes such as, for example, a conic surface of revolution. Preferably, the first face 222 and second face 224 include a planar surface transverse to the longitudinal axis A—A.

Disposed between the first piston 220 and the top 46 of the stack 100 is a ring like piston or second piston 240 mounted on the extension portion 230 so as to be axially slidable along the longitudinal axis A—A. The second piston 240 includes a sealing member, preferably an elastomer 242 disposed in a groove 245 formed on the outer circumference of the second piston 240 so as to generally prevent leakage of fluid 36 towards the stack 100. Preferably, the elastomer 242 is an O-ring. Alternatively, the elastomer 242 can be an O-ring of the type having non-circular cross-sections. Other types of elastomer seal can also be used, such as, for example, a labyrinth seal.

The second piston includes a surface 246 that forms, in conjunction with a surface 256 by a hermetic weld to form a second working surface 248 of the first bellows collar 252. Here, the second working surface 248 is disposed in a confronting arrangement with the first working surface, (i.e. the first working surface is the second face 224 of the first piston 220). Preferably, the pistons are circular in shape, although other suitable shapes, such as rectangular or oval, can also be used for the piston 220.

The second piston 240 is coupled to the extension portion 230 via bellows 250 and at least one elastic member or spring 260. The spring 260 is confined between a boss portion 280 and the second piston 240. Preferably, the boss portion 280 can be a spring washer that is affixed to the extension portion by a suitable technique, such as, for example, threading, welding, bonding, brazing, gluing and preferably laser welding. The bellows 250 includes a first bellows collar 252 and a second bellows collar 254. The first bellows collar 252 is affixed to the inner surface 244 of the second piston 240. The second bellows collar 254 is affixed to the boss portion 280. Both of the bellows collars can be affixed by a suitable technique, such as, for example, threading, welding, bonding, brazing, gluing and preferably laser welding. It should be noted here that the first bellows collar 252 is disposed for a sliding fit on the extension portion 230. Preferably, the first bellows collar 252 in its axial neutral (unloaded) condition has approximately 300 micrometer of clearance between the surfaces 248 and 224 at room temperature (approximately 20 degrees Celsius). From this position it can move approximately +/−100 microns to approximately +/−300 microns depending on the extreme operating conditions that are desired for the solid state actuator. Maximum operating temperature (approximately 140 degrees Celsius or greater) could increase this clearance to approximately 400 microns. Minimum operating temperature (approximately −40 degrees Celsius or lower) would decrease the clearance to approximately 250 microns.

The spring 260 can react against boss portion 280 to push the second working surface 248 towards the inlet 16. This causes a pressure increase in the fluid 36 that acts against the first face 222 and second face 224 of the first piston 220. In an initial condition, hydraulic fluid 36 is pressurized as a function of the spring force of the spring 260 and the second working surface 248. The pressurized fluid tends to flow into and out of the first reservoir 32 and the second reservoir 33 when the pressure in the first fluid reservoir is less than the pressure in the second reservoir. Where the pressure in the first reservoir 32 is lower than the second reservoir, such as in an initial condition, the pressure responsive valve 270 operates to permit fluid 36 to flow into the first reservoir 32. Prior to any expansion of the fluid in the first reservoir 32, the first reservoir is preloaded by the second working surface 248 and the spring force of the spring 260 so as to form a hydraulic shim. Preferably, the spring force of spring 260 is approximately 30 Newton to 70 Newton.

The fluid 36 that forms a hydraulic shim tends to expand due to an increase in temperature in and around the compensator. Since the first face 222 has a greater surface area than the second working surface 248, the first piston tends to move towards the stack or valve closure member 40 with a force $F_{out}$.

At rest, the respective pressures of the hydraulic shim and the second fluid reservoir tend to be generally equal. Since the friction force of sealing member 242 affects the pressure in the hydraulic shim and the second fluid reservoir equally, the sealing member 242 does not significantly affect the force $F_{out}$ of the piston. However, when the solid-state actuator is energized, the pressure in the hydraulic shim is increased because (a) the plate 270 seals tight against the face 222 and (b) the fluid 36 is incompressible as the stack expands. This allows the stack 100 to have a stiff reaction base in which the valve closure member 40 can be actuated so as to inject fuel through the fuel outlet 62.

Preferably, the spring 260 is a coil spring. Here, the pressure in the fluid is related to at least one spring characteristic of the coil spring. As used throughout this disclosure, the at least one spring characteristic can include, for example, the spring constant, spring free length and modulus of elasticity of the spring. Each of the spring characteristics can be selected in various combinations with other spring characteristic(s) described above so as to achieve a desired response of the compensator assembly.

Referring again to FIG. 1, during operation of the fuel injector 100, fuel is introduced at fuel inlet 24 from a fuel supply (not shown). Fuel at fuel inlet 24 passes through a fuel filter 16, through a passageway 18, through a passageway 20, through a fuel tube 22 and fuel tube 23, and out through a fuel outlet 62 when valve closure member 40 is moved to an open configuration.

In order for fuel to exit through fuel outlet 62, voltage is supplied to solid-state actuator stack 100, causing it to expand. The expansion of solid-state actuator stack 100 causes bottom 44 to push against valve closure member 40, allowing fuel to exit the fuel outlet 62. After fuel is injected through fuel outlet 62, the voltage supply to solid-state actuator stack 100 is terminated and valve closure member 40 is returned under the bias of spring 48 to close fuel outlet 62. Specifically, the solid-state actuator stack 100 contracts when the voltage supply is terminated, and the bias of the spring 48 which holds the valve closure member 40 in constant contact with bottom 44, also biases the valve closure member 40 to the closed configuration.

Referring to FIG. 1, length-changing actuator stack 100, which is operatively connected to the bottom surface of first piston 220, is initially pushed downward due to a pressurization of the fluid by the spring 260 acting on the second piston with a force $F_{out}$. The increase in temperature causes inlet fitting 12, injector housing 14 and valve body 17 to expand relative to the actuator stack 100 due to the generally higher volumetric thermal expansion coefficient of the fuel injector components relative to that of the actuator stack. This movement of the first piston is transmitted to the actuator stack 100 by a top 46, which movement maintains the position of the bottom 44 of the stack constant relative to the closure end 42. It should be noted that in the preferred embodiments, the thermal coefficient of the hydraulic fluid 36 is greater than the thermal coefficient of the actuator stack. Here, the compensator assembly can be configured by at least selecting a hydraulic fluid with a desired coefficient and selecting a predetermined volume of fluid in the first reservoir such that a difference in the expansion rate of the housing of the fuel injector and the actuator stack 100 can be compensated by the expansion of the hydraulic fluid 36 in the first reservoir.

When the actuator 100 is energized, pressure in the first reservoir 32 increases rapidly, causing the plate 270 to seal tight against the first face 222. This blocks the hydraulic fluid 36 from flowing out of the first fluid reservoir to the passage 226. It should be noted that the volume of the shim during activation of the stack 100 is related to the volume of the hydraulic fluid in the first reservoir at the approximate instant the actuator 100 is activated. Because of the virtual incompressibility of fluid, the fluid 36 in the first reservoir 32 approximates a stiff reaction base, i.e. a shim, on which the actuator 100 can react against. The stiffness of the shim is believed to be due in part to the virtual incompressibility of the fluid and the blockage of flow out of the first reservoir 32 by the plate 270. Here, when the actuator stack 100 is actuated in an unloaded condition, it extends by approximately 60 microns. It should be noted, however, that the extension of the stack is predictable as a function of the voltage applied. Therefore, a range of voltages applied can be used to obtain a range of deflection or opening of the closure member. As installed in a preferred embodiment, one-half of the quantity of extension (approximately 30 microns) is absorbed by various components in the fuel injector. The remaining one-half of the total extension of the stack 100 (approximately 30 microns) is used to deflect the closure member 40. Thus, a deflection of the actuator stack 100 is believed to be constant, as it is energized time after time, thereby allowing an opening of the fuel injector to remain consistent.

When the actuator 100 is not energized, fluid 36 flows between the first fluid reservoir and the second fluid reservoir while maintaining the same preload force $F_{out}$. The force $F_{out}$ is a function of the spring 260, the friction force due to the seal 242 and the surface area of each piston. Thus, it is believed that the bottom 44 of the actuator stack 100 is maintained in constant contact with the contact surface of valve closure end 42 regardless of expansion or contraction of the fuel injector components.

Hereafter, a preferable method of degasifying, filling and assembling the compensator assembly in a fuel injector is described. Initially, a first piston 220 with the extension portion 230 integrated to the piston 220 is provided along with the second piston 240, bellows 250 (having bellow collars 252 and 254), spring 260, the inlet fitting 28 with the seal 29 mounted on the inlet fitting 28 and body 210. The parts can be cleaned by a suitable chemical or physical cleaner, such as, for example, solvent, brushes and preferably by an ultrasonic cleaner. The plate 270, which has been preferably polished by chemicals, is affixed to the first piston face 222 by welds, preferably four laser welds. The bellows 250 is inserted with one bellows collar into the second piston 240 and affixed to the second piston by preferably laser welding. The second piston 240 is inserted along the extension portion 230 of the first piston 220. The other bellows collar is then affixed to the extension portion 230, preferably also by laser welding, although other suitable methods discussed previously can also be used. A spacer 400 is inserted between the second face 224 of the first piston 220 and the face 246 of the second piston 240 so as to provide a gap between the face 224 of the first piston and the face 246 of the second piston 240, the gap being preferably about 300 microns. The spring 260 is inserted so as to cincture the bellows 250. The boss portion 280, which functions as a spring retainer, is inserted thereafter setting a desired spring force and affixed, preferably by laser welding to the bellow collar 254. The seal 242 can be mounted on the second piston 240. The above completes the piston assembly of FIG. 3.

Figure 3:
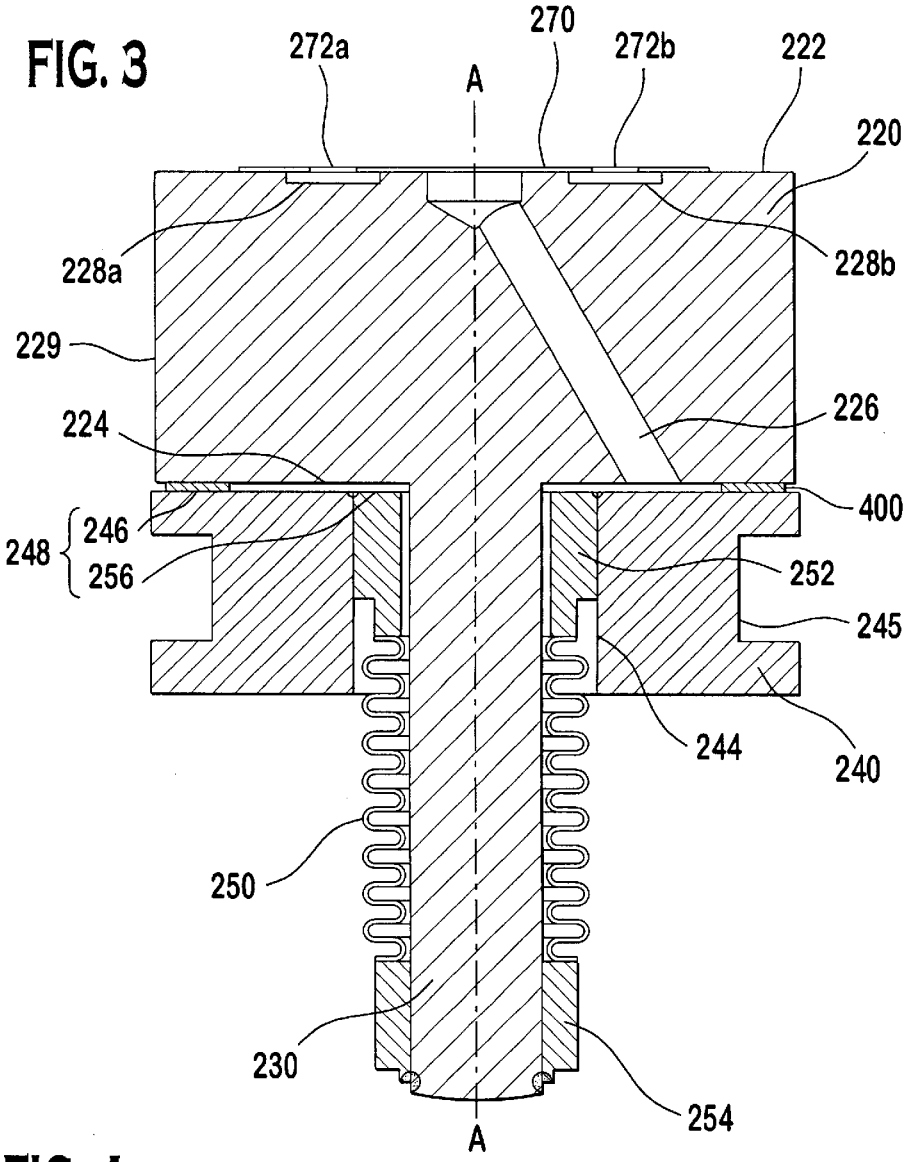
FIG. 3 is a view of the first and second pistons prior to assembly in the body of the compensator of FIG. 2.
Figure 4:
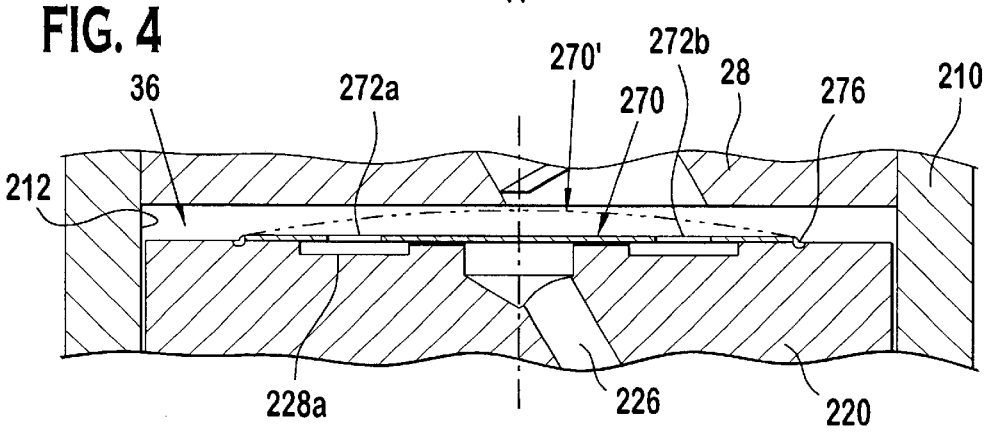
FIG. 4 is a view illustrating the operation of the pressure responsive valve of the compensator assembly.

The piston assembly of FIG. 3 (with a spacer 400 between the two pistons) is then immersed in a container (not shown) with a hydraulic fluid, preferably a silicone oil. The container is then placed in a chamber where the air pressure can be lowered so as to achieve a partial vacuum for a first predetermined time period, preferably between about 1–12 hours. As described herein, the partial vacuum denotes that the pressure in the chamber or container should be lower than ambient air pressure so as to cause gaseous medium dissolved in the fluid 36 to "degassify', i.e. to separate any gaseous medium from the fluid or from the internal parts of the compensator. The container can also be vibrated so as to facilitate the egress of dissolved and undissolved gases in the hydraulic fluid and piston assembly.

After the first predetermined time period, the body 210, the inlet fitting 28, the filler plug 38, the seals 29 and 242 are immersed in the hydraulic fluid in the container. While immersed, the spacer 400 is removed from between the face 224 and face 246. Thereafter, the inlet fitting 28 is inserted into the body 210 at one end while the piston assembly of FIG. 3 is inserted into the body 210 at the other end. Again, while all parts are immersed under the hydraulic fluid in the container (not shown), the pressure on the fluid or in the container is lowered yet again for a second predetermined time period, preferably between about 1–12 hours so as to degasify or remove dissolved and undissolved air or gases in the hydraulic fluid from the compensator assembly 200. Again, the container can be vibrated for a predetermined time period while under a partial vacuum so as to facilitate the egress of air (dissolved or undissolved) out of the compensator assembly 200. After the second predetermined time period, while still immersed, the filler plug is preferably threaded in the mating threads 30 of the inlet fitting 28. Thereafter, the compensator 200 can be removed from the container and assembled with the remaining components of the fuel injector 10.

Although the compensator assembly 200 has been shown in combination with a piezoelectric actuator for a fuel injector, it should be understood that any length changing actuator, such as, for example, an electrostrictive, magnetostrictive or a solid-state actuator could be used with the compensator assembly 200. Here, the length changing actuator can also involve a normally deenergized actuator whose length is expanded when the actuator energized. Conversely, the length-changing actuator is also applicable to where the actuator is normally energized and is de-energized so as to cause a contraction (instead of an expansion) in length. Moreover, it should be emphasized that the compensator assembly 200 and the length-changing solid state actuator are not limited to applications involving fuel injectors, but can be for other applications requiring a suitably precise actuator, such as, to name a few, switches, optical read/write actuator or medical fluid delivery devices.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of degasifying air in a hydraulic compensator, the compensator having a body including a first body end and a second body end, the first body end and second body end extending along a longitudinal axis, the body having a body inner surface facing the longitudinal axis and a fitting, a piston assembly including a first piston having a first working surface and a second working surface distal to the first working surface, the first piston including an extension portion coupled to the first piston, a second piston disposed proximate the extension portion of the first piston and having a spring disposed therebetween, the second piston having a surface that confronts the second working surface, a first sealing member coupled to the second piston, and a flexible fluid barrier coupled to the first piston and the second piston, the method comprising:

immersing the piston assembly in a container of fluid; and establishing a first pressure on a medium acting on the fluid that is lower than ambient air pressure so that a gaseous medium trapped in at least one of the fluid and the piston assembly is generally removed therefrom.

2. The method of claim 1, wherein the immersing further comprises forming a gap between the first piston and the second piston so as to form a hydraulic reservoir.

3. The method of claim 2, wherein the immersing further comprises placing a spacer between the first and second piston.

4. The method of claim 1, wherein the establishing further comprises immersing the body including the first piston coupled to the second piston, the fitting and the spring under fluid in the container at the first pressure for a predetermined time period.

5. The method of claim 1, wherein the immersing further comprises vibrating the container.

6. The method of claim 4, wherein the immersing further comprises vibrating the container.

7. A method of filling fluid in a compensator of a fuel injector, the compensator having a body including a first body end and a second body end extending along a longitudinal axis, the body having a body inner surface facing the longitudinal axis and a fitting, a first piston having a first working surface and a second working surface distal to the first working surface, the first piston including an extension portion coupled to the first piston, a second piston disposed proximate the first piston, the second piston having a surface that confronts the second working surface, a first sealing member coupled to the second piston, and a flexible fluid barrier, the method comprising:

providing a gap between the first piston and the second piston by coupling the first piston and second piston to form a piston assembly;

immersing the piston assembly in a container containing fluid; and establishing a pressure on the fluid in the container to a predetermined pressure for at least one predetermined time period.

8. The method according to claim 7, wherein the at least one predetermined time period is approximately 1–12 hours so as to allow gases to flow out and fluid to back fill the piston assembly.

9. The method of claim 7, wherein the coupling further comprises coupling a thin orifice plate to one of the first and second working surfaces of the first piston.

10. The method of claim 7, wherein the coupling comprises connecting the flexible fluid barrier between the second piston and the extension portion.

11. The method of claim 10, wherein the coupling further comprises disposing a spring between the first piston and the second piston so as to bias the surface of the second piston towards the second working surface of the first piston.

12. The method of claim 7, wherein the providing comprises placing a spacer between the first and second piston.

13. The method of claim 7, wherein the immersing further comprises:

assembling the fitting and the piston assembly in the body; and immersing the body in the container at the predetermined pressure for a second of the at least a predetermined time period.

14. The method of claim 7, wherein the immersing further comprises vibrating the container for another predetermined time period within the at least one predetermined time period.

15. The method of claim 7, wherein the predetermined pressure is lower than ambient atmospheric pressure.

* * * * *